US010137551B2

(12) United States Patent
Bernhardt

(10) Patent No.: US 10,137,551 B2
(45) Date of Patent: Nov. 27, 2018

(54) SANDING APPARATUS

(71) Applicant: Thomas J. Bernhardt, Northport, NY (US)

(72) Inventor: Thomas J. Bernhardt, Northport, NY (US)

( * ) Notice: Subject to any disclaimer, the term of this patent is extended or adjusted under 35 U.S.C. 154(b) by 141 days.

(21) Appl. No.: 15/137,903

(22) Filed: Apr. 25, 2016

(65) Prior Publication Data

US 2017/0100811 A1 Apr. 13, 2017

Related U.S. Application Data

(60) Provisional application No. 62/152,628, filed on Apr. 24, 2015.

(51) Int. Cl.

| | |
|---|---|
| ***B24B 23/02*** | (2006.01) |
| ***B24B 7/18*** | (2006.01) |
| ***B24B 55/10*** | (2006.01) |

(52) U.S. Cl.

CPC ..... *B24B 7/182* (2013.01); *B24B 7/188* (2013.01); *B24B 23/02* (2013.01); *B24B 55/102* (2013.01)

(58) Field of Classification Search

CPC ..... B24B 7/182; B24B 23/02; B24B 55/102

USPC ..... 451/354, 352, 358, 59

See application file for complete search history.

(56) References Cited

U.S. PATENT DOCUMENTS 1,011,490 A * 12/1911 Rasmesen ..... B24B 23/02 144/115
1,977,088 A * 10/1934 Richardson ..... B24B 55/05 15/389
3,597,883 A * 8/1971 Choplin ..... B24B 23/02 451/358
3,793,782 A * 2/1974 Bowling ..... B24B 23/02 15/23
3,826,045 A * 7/1974 Champayne ..... B24B 55/102 451/359
4,062,152 A * 12/1977 Mehrer ..... B24B 55/06 451/344
4,780,992 A * 11/1988 McKervey ..... A47L 11/145 15/1.7
4,964,243 A * 10/1990 Reiter ..... B24B 55/10 451/354
4,967,513 A * 11/1990 Hundebol ..... B24B 21/16 451/296
5,193,313 A * 3/1993 Sanchez ..... B24B 55/105 451/344
5,239,783 A * 8/1993 Matechuk ..... B24B 7/184 451/354
5,245,797 A * 9/1993 Milkie ..... B24D 15/023 451/354
5,297,363 A * 3/1994 Schroder ..... B08B 7/024 451/354
5,301,472 A * 4/1994 Lyng ..... B08B 1/04 15/23

(Continued)

*Primary Examiner* — George Nguyen

(74) *Attorney, Agent, or Firm* — H. John Rizvi; Gold & Rizvi, P.A.

(57) ABSTRACT

A sanding apparatus for sanding a vicinity of a drywall seam is provided comprising a housing structure including guide structures, a sanding roller, and a motor for driving the sanding roller such that the guide structures guide a sanding depth during sanding. The sanding apparatus further includes a vacuuming mechanism for capturing particles that result from sanding.

19 Claims, 14 Drawing Sheets

(56) References Cited

U.S. PATENT DOCUMENTS

| | | | | | |
|---|---|---|---|---|---|
| 5,309,594 | A * | 5/1994 | Thompson | B24B 23/02 | 15/29 |
| 5,419,087 | A * | 5/1995 | Haddy | B24D 9/04 | 451/344 |
| 5,540,616 | A * | 7/1996 | Thayer | B24B 55/10 | 451/354 |
| 5,545,080 | A * | 8/1996 | Clowers | B24B 7/184 | 451/354 |
| 6,213,694 | B1 * | 4/2001 | Ichikawa | B24B 23/02 | 409/139 |
| 7,014,546 | B1 * | 3/2006 | Birk | B24B 7/188 | 451/354 |
| 7,022,003 | B1 * | 4/2006 | Hughes | A47L 11/18 | 451/352 |
| 7,156,728 | B1 * | 1/2007 | Killough | B24B 23/005 | 451/354 |
| 7,597,611 | B2 * | 10/2009 | Lamers | B24D 15/04 | 451/354 |
| 7,867,064 | B2 * | 1/2011 | Field | B24D 15/04 | 451/344 |
| 8,480,457 | B2 * | 7/2013 | Kundel, Jr. | B24B 23/02 | 15/23 |
| 8,721,400 | B2 * | 5/2014 | Ouellette | B24B 49/00 | 451/352 |
| 2005/0287937 | A1 * | 12/2005 | Florio | B24B 7/184 | 451/354 |
| 2008/0085664 | A1 * | 4/2008 | Weiford | B24B 7/184 | 451/259 |
| 2011/0250825 | A1 * | 10/2011 | Smith | B24B 27/08 | 451/259 |
| 2011/0275294 | A1 * | 11/2011 | Lien | B24D 15/02 | 451/540 |

* cited by examiner

SANDING APPARATUS

CROSS-REFERENCE TO RELATED APPLICATION

This application claims the benefit of U.S. Provisional Patent Application Ser. No. 62/152,628, filed Apr. 24, 2015, which is incorporated herein in its entirety.

FIELD OF THE INVENTION

The present invention relates generally to sanding apparatuses, and more particularly, to an apparatus for sanding drywall seams in a manner that flattens and/or removes surface variances, inconsistencies, bumps and/or grooves and removes particles resulting from sanding.

BACKGROUND OF THE INVENTION

A common technique for constructing walls, ceilings and various flat surfaces is to join two sheets of drywall. Once joined, a seam forms between two drywall sheets. It is common to fill such seams with an adhesive agent to adhere the sheets and ultimately provide a flat surface with no visible or palpable seam. Once an adhesive agent is applied and spread into a seam, the surface of the seam is sanded to remove any surface level variances or inconsistencies, producing a smooth, flat surface.

However, traditional drywall sanding tools do not effectively prevent inconsistencies, bumps and/or grooves caused by over sanding. Instead, traditional drywall sanding tools engage a target surface only by a sanding portion of a device with no sanding depth guide or limiter, requiring an operator to judge a sanding depth by either adjusting a manual force applied to the sanding tool, by visually judging a sanding depth, and/or by guessing a sanding depth by counting how much time was spent sanding a particular spot. Such issues of traditional sanding tools result in liability issues, ruined drywall sections, and may substantially increase total costs of construction projects and operator training. As such, there is a need for a drywall sanding tool that may guide or limit a sanding depth.

Further, when a drywall seam is filled by an adhesive agent or joint compound, otherwise known as "spackle", the spackle is then usually scraped by a spatula to remove any lumps or bumps caused by the spackle protruding out of the seam. However, once scraped as described, a vicinity of the seam may still have bumps, lumps and/or inconsistencies caused by the spackling process. Unfortunately, traditional drywall sanding tools only allow an operator to sand an entire surface of drywall seam, causing unwanted sanding in a case where only a vicinity of a seam requires sanding.

Furthermore, sanding drywall or spackle causes clouds of dust to form in a work area, causing discomfort and health concerns. As such, the market for drywall sanders appreciates improved drywall sanders having built-in vacuuming mechanisms.

As such, there exists a need for a sanding tool that is configured to substantially sand a vicinity of a spackled drywall seam instead of majorly sanding directly above the spackled drywall seam and a sanding tool that concurrently sands and keeps sanding work area free from sanding dust.

SUMMARY OF THE INVENTION

This summary is provided to introduce a selection of concepts in a simplified form that are further described below in the detailed description. This summary is not intended to identify key features of essential features of the claimed subject matter, nor is it intended to be used to limit the scope of the claimed subject matter. Furthermore, the claimed subject matter is not limited to implementations that solve any or all disadvantages noted in any part of this disclosure.

According to embodiments of the present disclosure, a sanding apparatus includes a U-shaped structure, a roller between two arms of the U-shaped structure, a handle where the two arms meet, an electric motor coupled to the roller for driving the roller, and a pair of wheels on opposite ends of the roller. The pair of wheels and the roller are configured to engage a substantially planar target surface for sanding. The roller accepts attachment of sandpaper and is rotatably driven by the electric motor about a fixed axis that is substantially parallel to an axis shared by the pair of wheels. The wheels freely rotate and act as a sanding depth guide, preventing the roller from over sanding. As such, the sanding apparatus removes undesired surface level variations and/or inconsistencies and produces a consistent, smooth and/or flat surface without risk of over sanding.

In a second aspect, the roller may be cylindrical or concave, in order to better sand vicinities of drywall seams of a variety drywall configurations available in the market.

In another aspect, the roller may be coated with an abrasive material.

In another aspect, the roller may be removable and/or replaceable.

In another aspect, the two arms comprise two arm ends that include a means for attaching the roller.

In another aspect, the handle may be pivotable with respect to the U-shaped structure.

In another aspect, the handle is fixed relative to the U-shaped structure.

In another aspect, the handle is substantially rigid.

In another aspect, the wheels may be configured to rotate in conjunction upon rolling over a target surface, such that rolling one wheel causes the opposing wheel of the pair of wheels to rotate.

In another aspect, the sanding apparatus can further include a vacuuming mechanism configured to collect dust and free particles that result from the apparatus sanding a target surface.

In another aspect, the vacuuming mechanism can be attached to the handle or to the U-shaped structure.

In another aspect, the vacuuming mechanism includes vacuum generating devices, such as a fan.

In another aspect, the vacuuming mechanism may include one or more various tubes and nozzles to appropriately capture particles near a target sanding surface.

In another aspect, the vacuuming mechanism may include various vents or holes that may filter vacuuming exhaust.

In another aspect, the vacuuming mechanism includes a vacuuming container that is removable, replaceable and/or cleanable.

In another aspect, the U-shaped structure may be Y-shaped or V-shaped.

In another aspect, one or more of the elements of the sanding apparatus are composed of one or a combination of wood, metal, plastic, rubber.

In another aspect, one or more of the elements of the sanding apparatus are composed of a composite material.

In another aspect, the sanding depth may be adjusted by an operator for an application that requires a particular sanding depth.

In another aspect, the wheels may be composed of plastic, wood, rubber and/or the like.

In another aspect, the wheels may be an inflatable tire.

In another aspect, the sanding depth may be adjusted, chosen or selected by selecting a particular material and/or tire pressure of the wheels.

In another aspect, a sanding depth may be adjusted by selecting a roller with a particular circumference relative to a circumference of the wheels.

Further, disclosed is a vacuum sanding apparatus for sanding a drywall seam and vacuuming resulting sanding dust, the vacuum sanding apparatus comprising, a sanding assembly, the sanding assembly including a motor for driving a sanding roller about a drive axis for sanding a target surface, a handle for maneuvering the sanding assembly in sanding the target surface, a vacuuming mechanism including a vacuum channel structure that defines a vacuum channel fluidly connecting a vacuum nozzle of the channel structure and a vacuum generator, the vacuum nozzle disposed near the sanding roller for capturing sanding dust resulting from sanding the target surface, and a pair of guide structures attached to the sanding assembly for guiding a sanding depth of sanding the target surface.

In another aspect, the channel structure is rigidly connected to the handle.

In another aspect, the pair of guide structures engage a target surface for guiding the sanding depth.

In another aspect, the sanding depth is determined by a distance between a sanding surface of the sanding roller and a point on the guide structures that is configured to engage the target surface when the target surface is being sanded for guiding the sanding depth.

In another aspect, the handle is pivotably attached to the sanding assembly.

In another aspect, the pair of guide structures is configured to move upon engaging the target surface during sanding.

In another aspect, the sanding roller has a concave surface for sanding a vicinity of a drywall seam.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the claimed subject matter will hereinafter be described in conjunction with the appended drawings provided to illustrate and not to limit the scope of the claimed subject matter, where like designations denote like elements, and in which:

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
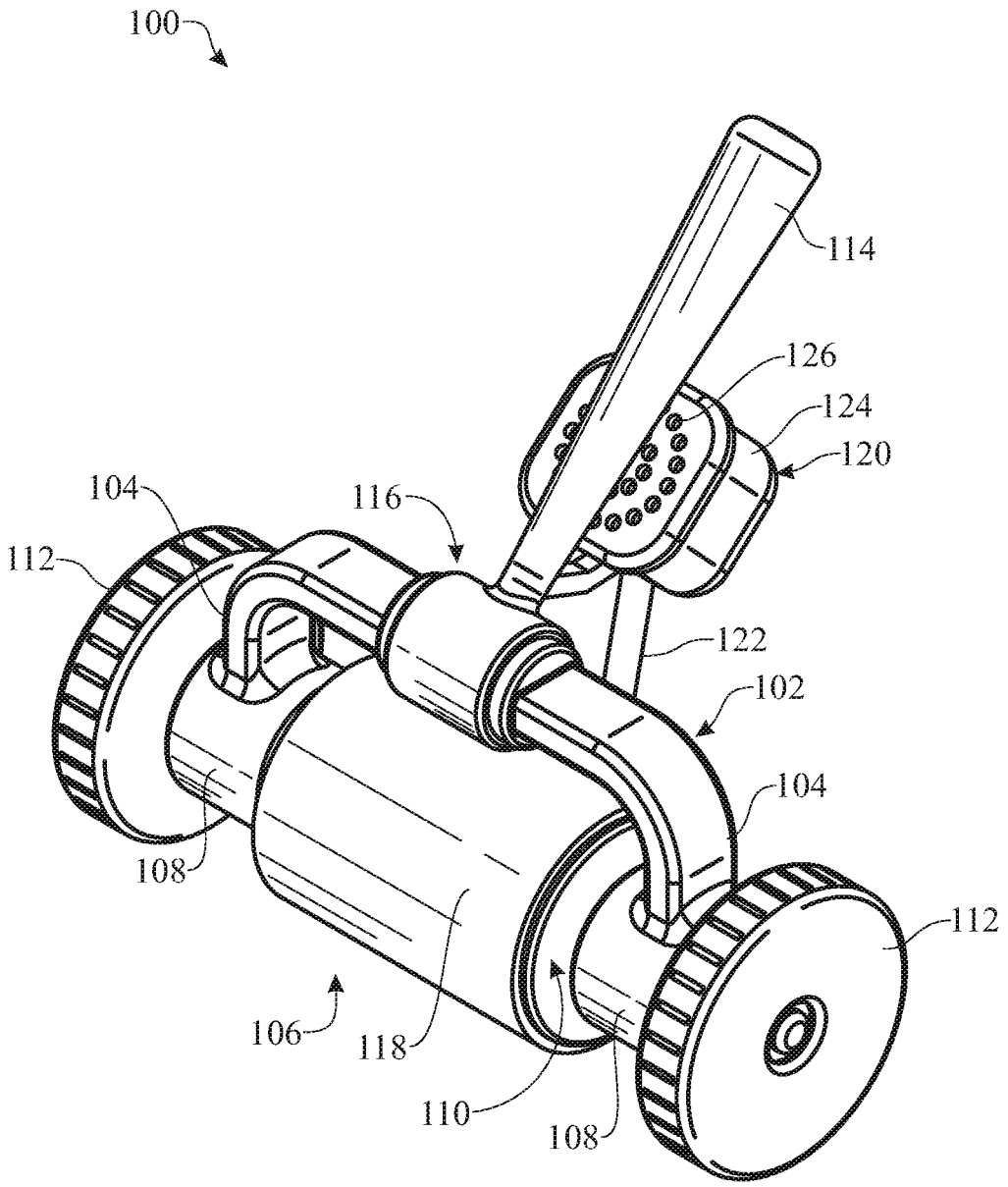
FIG. 1 presents an isometric front top view of a first exemplary embodiment of a sanding apparatus.

The illustrations of FIGS. 1-7 show a sanding apparatus 100 in accordance with a first exemplary embodiment of the present invention. The sanding apparatus is also invariably referred to herein as a vacuum sanding apparatus or a sanding assembly. For example, referring to a sanding assembly may refer specifically to the combination of herein described elements that drive a sanding roller (e.g. roller 110). Below described elements of sanding apparatus 100 shown in FIG. 1 are appropriately referenced in FIGS. 1-7. The illustration of FIG. 1 shows sanding apparatus 100 including a U-shaped structure 102 forming two opposing arms 104 that extend toward a first side 106 of U-shaped structure 102. U-shaped structure 102 may be composed of any suitable material and shaped in any suitable way without departing from the scope of this disclosure. For example, U-shaped structure 102 may be composed of plastic, metal or various combinations of any material. As another example, U-shaped structure 102 may take form as a V-shape or a Y-shape. Arms 104 may be composed of any appropriate material. Arms 104 are shown in FIG. 1 as being formed by the U-shaped structure 102. However, arms 104 may be composed of two separate structures joined together or joined to the U-shaped structure by various means. Arm ends 108 may include a means for attaching roller 110 and/or wheels 112.

A handle 114 is attached to the U-shaped structure 102 at a second side 116 that is opposite first side 106, where arms 104 meet. Handle 114 may be fixedly attached or pivotably attached to the U-shaped structure by any means. For example, handle 114 may be pivotably attached to pivot about one or more degrees of freedom relative to U-shaped structure 102 Handle 114 is designed to be wielded by an operator, providing handheld and/or manual control of sanding apparatus 100. Handle 114 may take any shape or length. Handle 114 may be composed of plastic, metal, wood and/or any suitable material or composite with any rigidity or characteristic.

Figure 2:
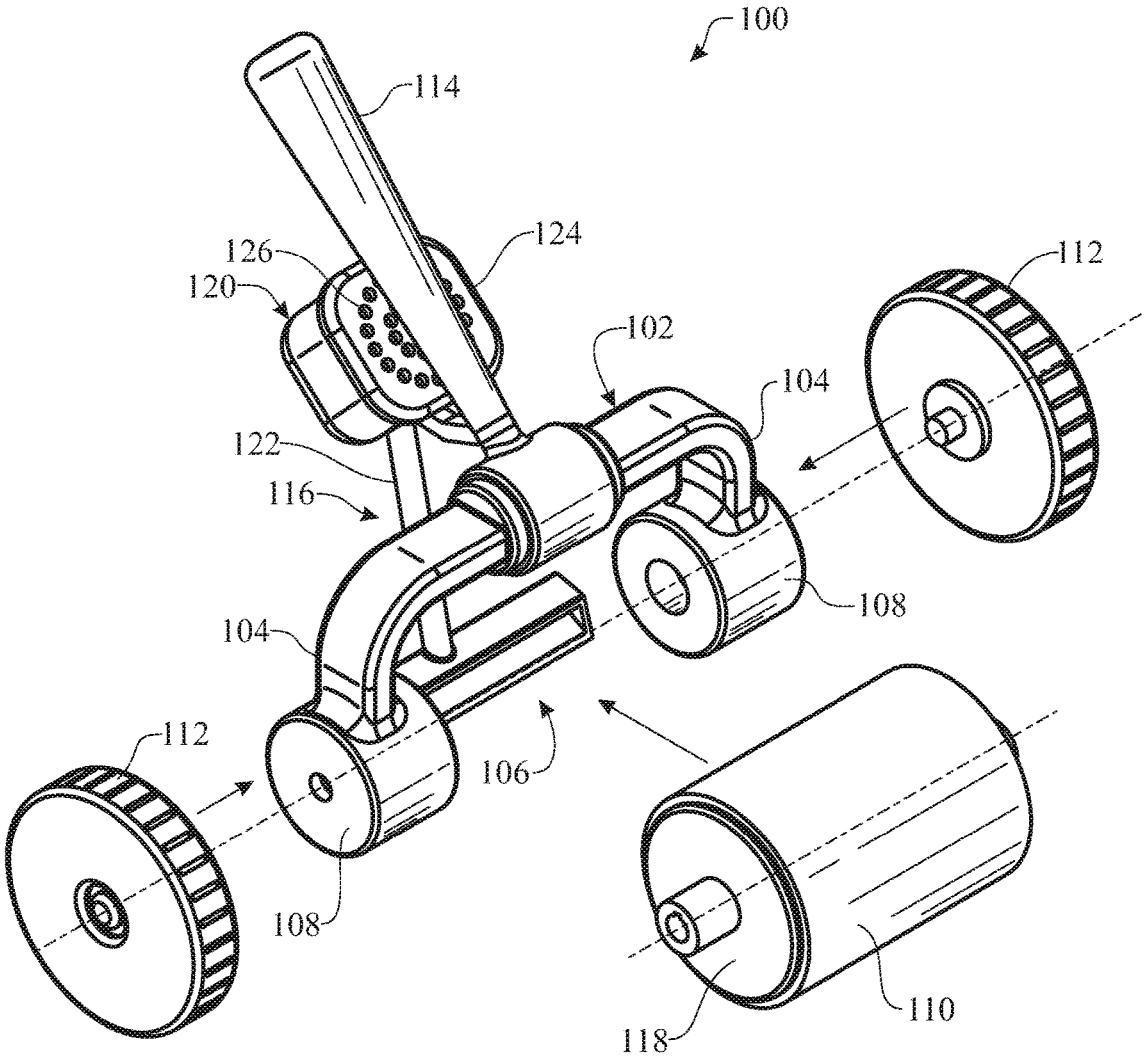
FIG. 2 presents an isometric front top view of the sanding apparatus of FIG. 1, shown disassembled.
Figure 3:
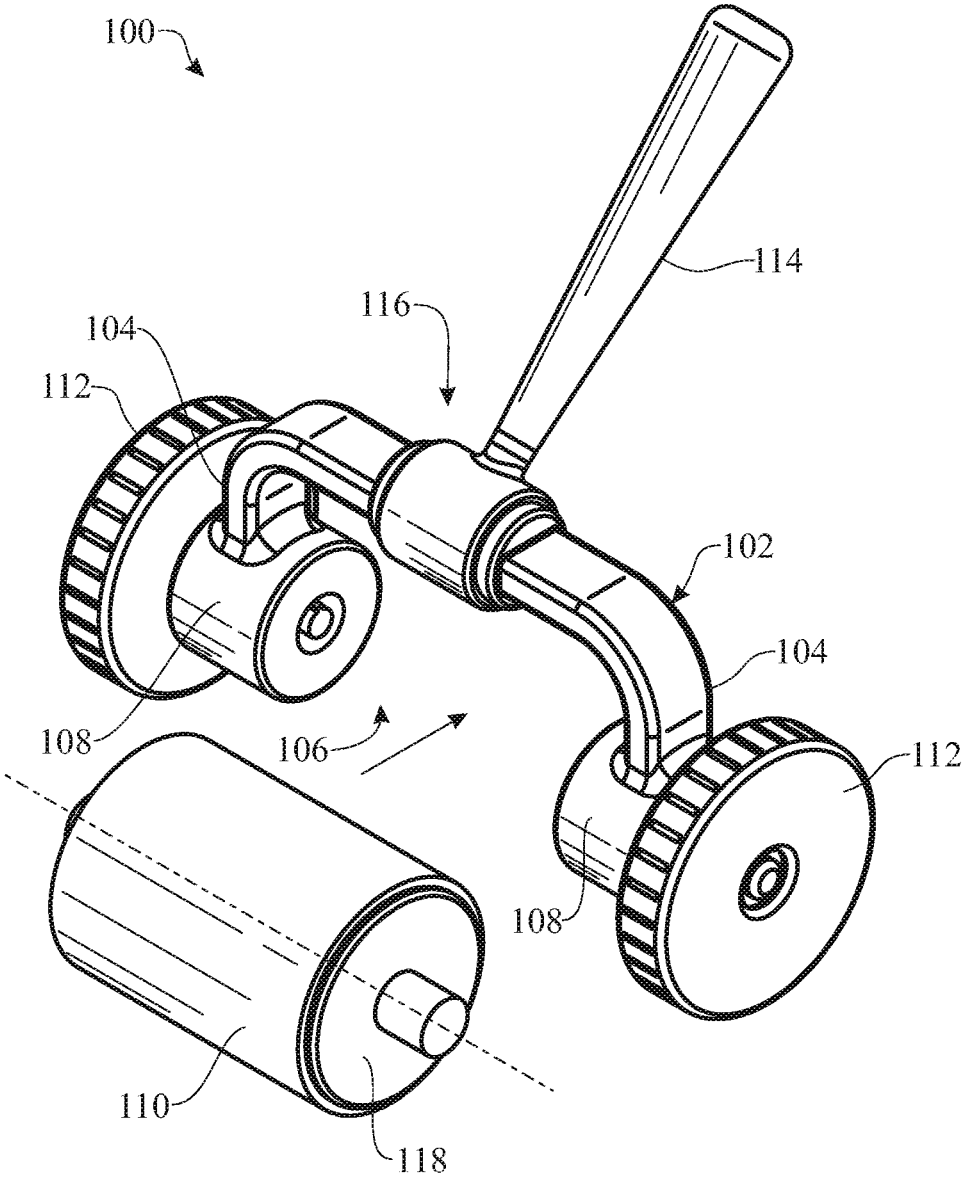
FIG. 3 presents an isometric front top view of the sanding apparatus of FIG. 1, shown partially assembled.
Figure 4:
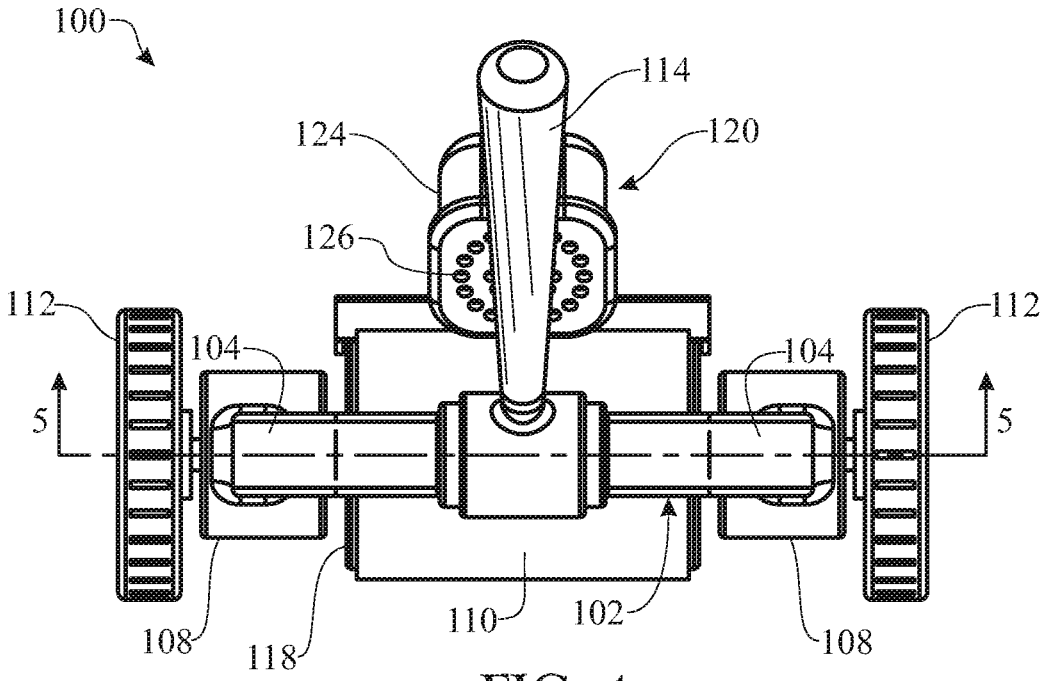
FIG. 4 presents a top plan view of the sanding apparatus of FIG. 1.
Figure 5:
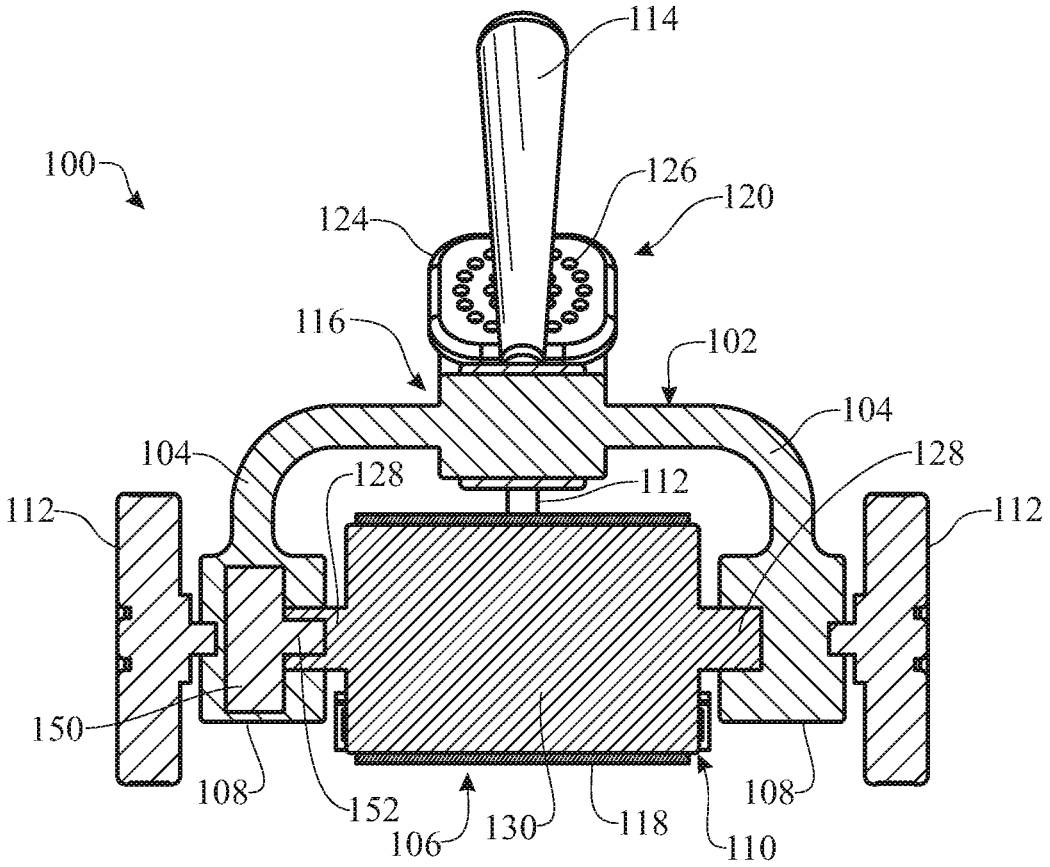
FIG. 5 presents a cross-sectional front elevation view of the sanding apparatus of FIG. 1, the cross section taken along a sectional plane 5-5 indicated in FIG. 4.

Roller 110 is rotatably supported by and disposed between arms 104 near arm ends 108, the roller 110 being able to accept attachment of sandpaper 118. For example, the cross-sectional view of FIG. 5 shows sandpaper 118 attached to roller 110. Alternatively, roller 110 may be coated with an abrasive surface or be abrasive in nature without requiring coating or the placing of accessory sandpaper. Turning back to FIG. 1, arm ends 108 may include means for attaching roller 110. The embodiment depicted in FIGS. 1-7 show roller 110 in form of a cylinder (e.g. with a cylindrical outer sanding surface). However, in alternative embodiments, roller 110 may take any shape. Roller 110 may have any radius or length. Roller 110 may be composed of any suitable material, such as foam, plastic, wood, metal or a composite. Roller 110 and its support and/or attachment means may be configured to be removable and/or replaceable by an operator. For example, FIGS. 2 and 3 show how roller 110 may be removed and attached.

Figure 6:
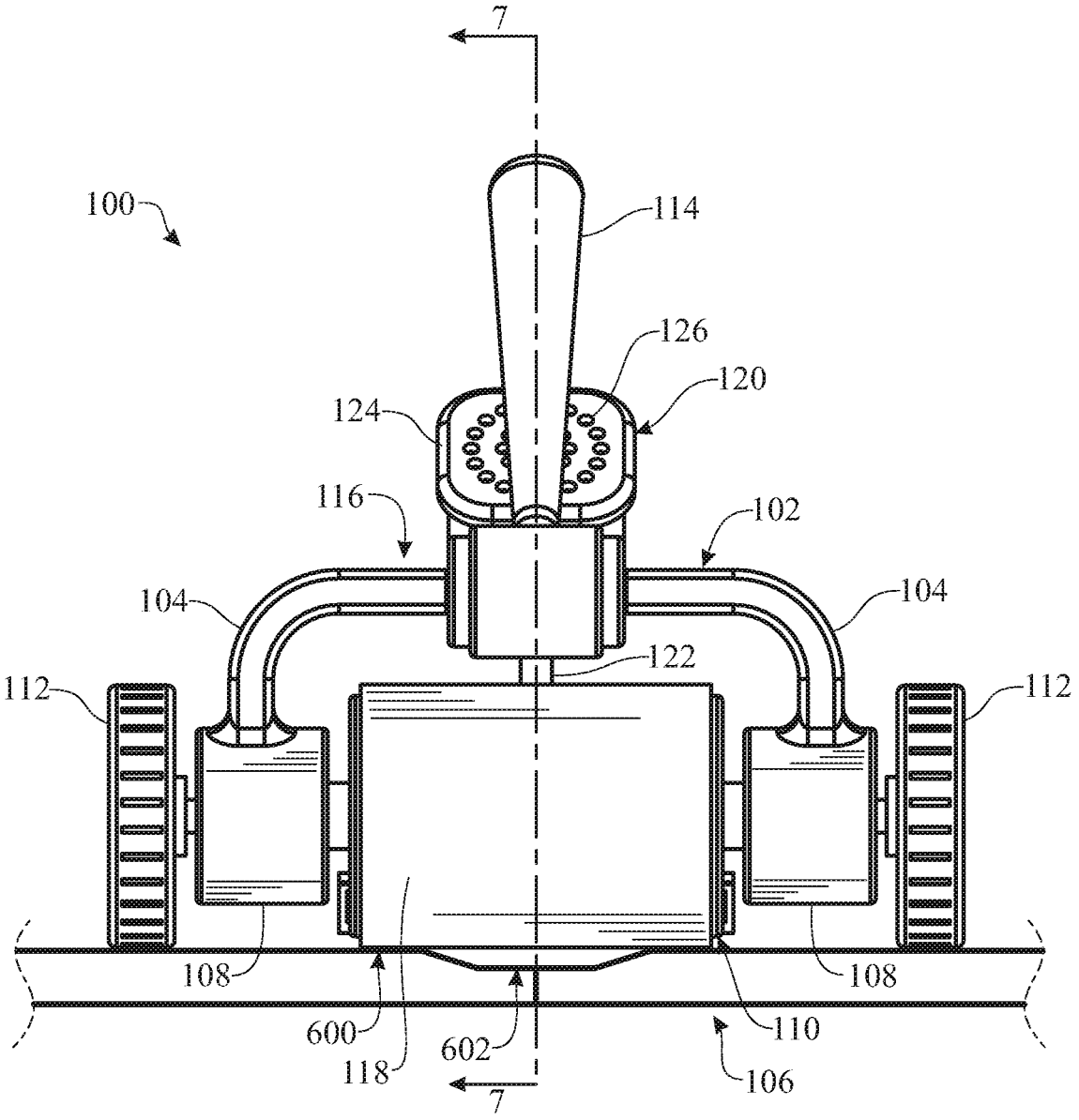
FIG. 6 presents a front elevation view of the sanding apparatus of FIG. 1, shown in operation on a tapered drywall seam.
Figure 7:
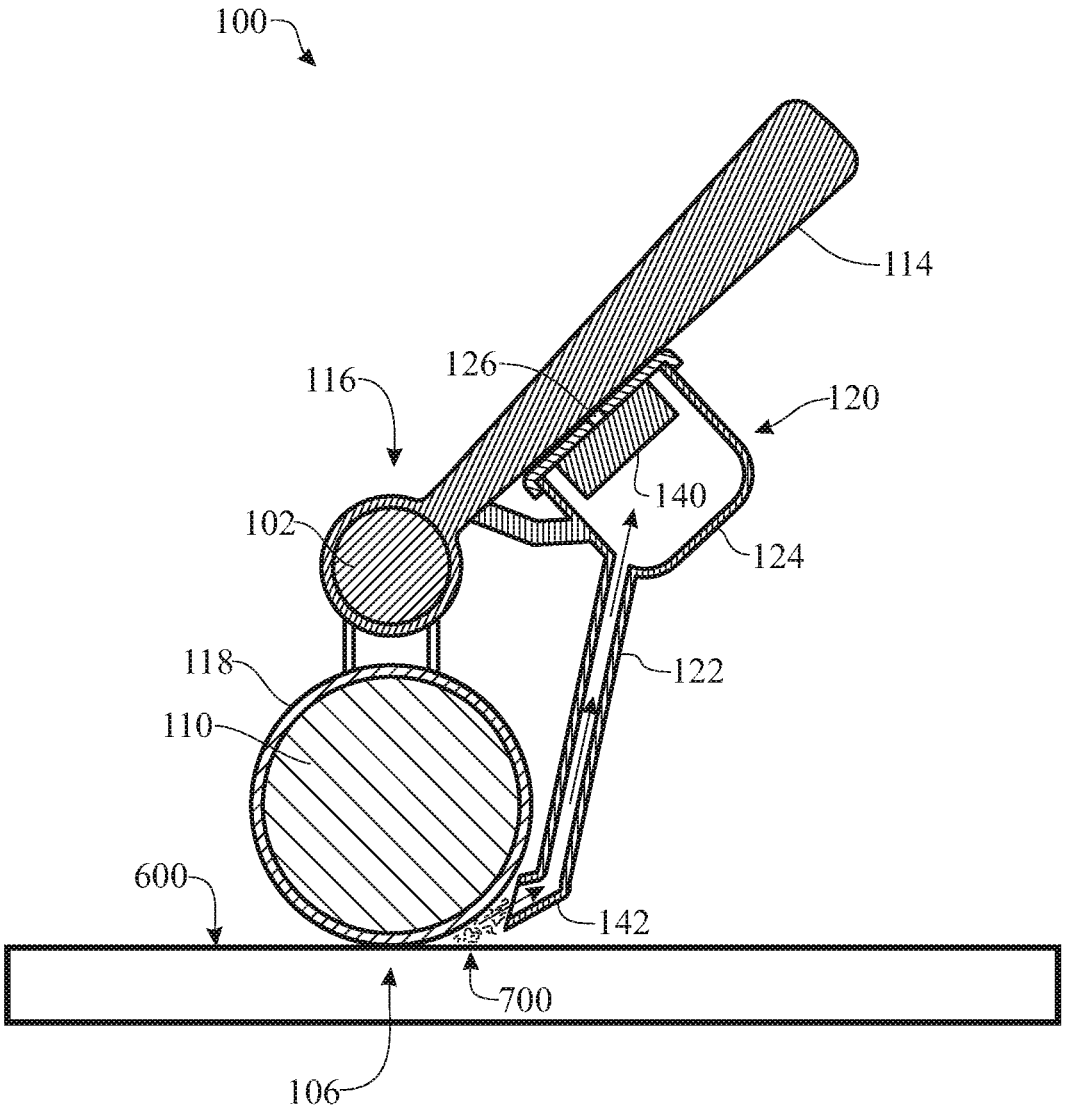
FIG. 7 presents a cross-sectional side elevation view of the sanding apparatus of FIG. 1, the cross section taken along sectional plane 7-7 indicated in FIG. 6.

In turn, sandpaper 118 may be of any grade or composed of any suitable material. For example, a suitable grade of sandpaper may be chosen for a particular sanding project. Sandpaper 118 may be removed from roller 110. For example, if sandpaper 118 has worn down due to sanding, sandpaper 118 may be replaced by an operator. Sandpaper 118 is attached to roller 110 such that roller 110 may be rotatably driven to sand a target surface. For example, FIGS. 6 and 7 show roller 110 engaging surface 600 for sanding. Particularly, FIG. 6 shows sanding apparatus 100 sanding a vicinity of tapered drywall seam 602. Sanding apparatus may sand a spackled or a non-spackled seam.

Turning to FIG. 5, an electric motor 150 is coupled to roller 110. Electric motor 150 rotatably drives roller 110 about a fixed drive axis, where the drive axis is substantially subtended by arms 104. Electric motor 150 may be attached to any appropriate point on U-shaped structure 102. For instance, the U-shaped structure 102 of the present embodiment is such that the arm ends 108 are wider than the rest of the arm, and the electric motor 150 is embedded or housed in one of the arm ends 108. It is to be understood that roller 110 may be driven by any means, for example via a gas-powered or hydraulic driving system. Electric motor 150 and roller 110 are configured such that the drive axis remains substantially fixed relative to U-shaped structure 102 without tilting and/or shifting. Coupling between the electric motor 150 and roller 110 may be accomplished in any suitable means to drive the roller. For instance and without limitation, a motor axle 152 is non-rotationally coupled to one of two opposite roller end portions 128 extending from a cylindrical main body 130 of the roller 110; by non-rotationally, it is understood that rotation of the motor axle 152 causes the attached roller end portion 128, and thus the entire roller 110, to rotate.

The illustrations of FIGS. 1-6 show a pair of wheels 112 (also referred to herein invariably as guide structures) rotatably supported by U-shaped structure 102. Particularly, wheels 112 may be rotatably supported by arms 104. In the present embodiment, wheels 112 are supported by the wider arm ends 108 and disposed at opposite ends of roller 110. Each arm of arms 104 may rotatably support one wheel. Each wheel of pair of wheels 112 may rotate freely relative to an opposing wheel. Alternatively, each wheel may be configured to rotate together. For example, rotating one wheel may cause the opposing wheel to rotate. Wheels 112 rotate freely relative to U-shaped structure 102, rotate about a wheel axis that is substantially parallel to the above mentioned drive axis, and are configured to limit a sanding depth of the sanding apparatus. Wheels 112 are configured engage or contact a planar surface, and rotate and move upon displacing, maneuvering, rolling, moving and/or translating sanding apparatus 100 over (across) an engaged surface by means of operating handle 114. Wheels 112 may be composed of any material, such as plastic, rubber, wood or the like. Wheels 112 may be an inflatable tire that may be inflated to a desired tire pressure. Wheels 112 limit a sanding depth according to a distance between a lowest point of the circumference of roller 110 and a lowest point of a circumference of wheels 112. For description purposes, the lowest points are closest to a target surface that is to be engaged and/or farthest from the above mentioned second side 116 of the U-shaped structure. For example, a lowest point of the circumference of roller 110 may be slightly lower than a lowest point of the circumference of wheels 112, such that upon engagement of a surface, roller 110 may sand the surface until wheels 112 engage the surface, preventing over sanding by providing a sanding depth guide. Sanding depth may take any appropriate value and may be adjusted, chosen or selected by various means. For example, a sanding depth may be chosen by an operator by selecting a roller circumference and/or a wheel circumference. As another example, a sanding depth may be chosen by selecting a particular material and/or tire pressure for wheels 112. For example, a soft material may be chosen for wheels 112 which may result in greater sanding depth.

The illustrations of FIGS. 1-7 show a vacuuming mechanism 120 is attached to handle 114 and configured to capture particles (dust) near roller 110 by disposing a nozzle of the vacuuming mechanism near the roller 110 during sanding. For example, the vacuuming mechanism 120 captures or vacuums sanding dust particles resulting from sanding a target surface with the sanding apparatus. As such, vacuuming mechanism 120 captures particles near the roller 110 that result from sanding a target surface, such as surface 600 of FIGS. 6 and 7. The illustration of FIG. 7 shows vacuuming mechanism 120 capturing particles 700.

The illustrations of FIGS. 1-7 show vacuuming mechanism 120 including a vacuuming tube 122, a vacuuming container 124 and vents 126. The vacuuming mechanism and the vacuuming tube 122 may be rigidly attached to the handle 114. Vacuuming mechanism 120 may include any appropriate vacuum generators for generating a vacuum. In some embodiments, a fan may be included for generating a vacuum. For example, FIG. 7 shows vacuuming mechanism 120 including a vacuum generator 140, vacuuming tube 122 comprising a vacuuming nozzle 142, vacuuming container 124 and vents 126. The vacuuming tube 122 (vacuum channel structure) defines a vacuuming channel within the tube, the vacuuming channel fluidly connecting the vacuuming nozzle (opening) with the vacuum generator 140 and/or the vacuuming container 124. Vacuuming container 124 is configured to be removable, replaceable and cleanable. The vacuum generator 140 of the present embodiment is arranged inside the vacuuming container 124, providing a sleek and integrated appearance to the sanding apparatus 100. Vacuuming mechanism 120 as shown in FIGS. 1-7 is attached to handle 114 and may pivot along with handle 114 with respect to the U-shaped structure 102. Alternatively, vacuuming mechanism 120 may be separate from handle 114 and/or may not pivot in conjunction with handle 114. Vacuuming mechanism 120 may be attached to U-shaped structure 102.

Figure 8:
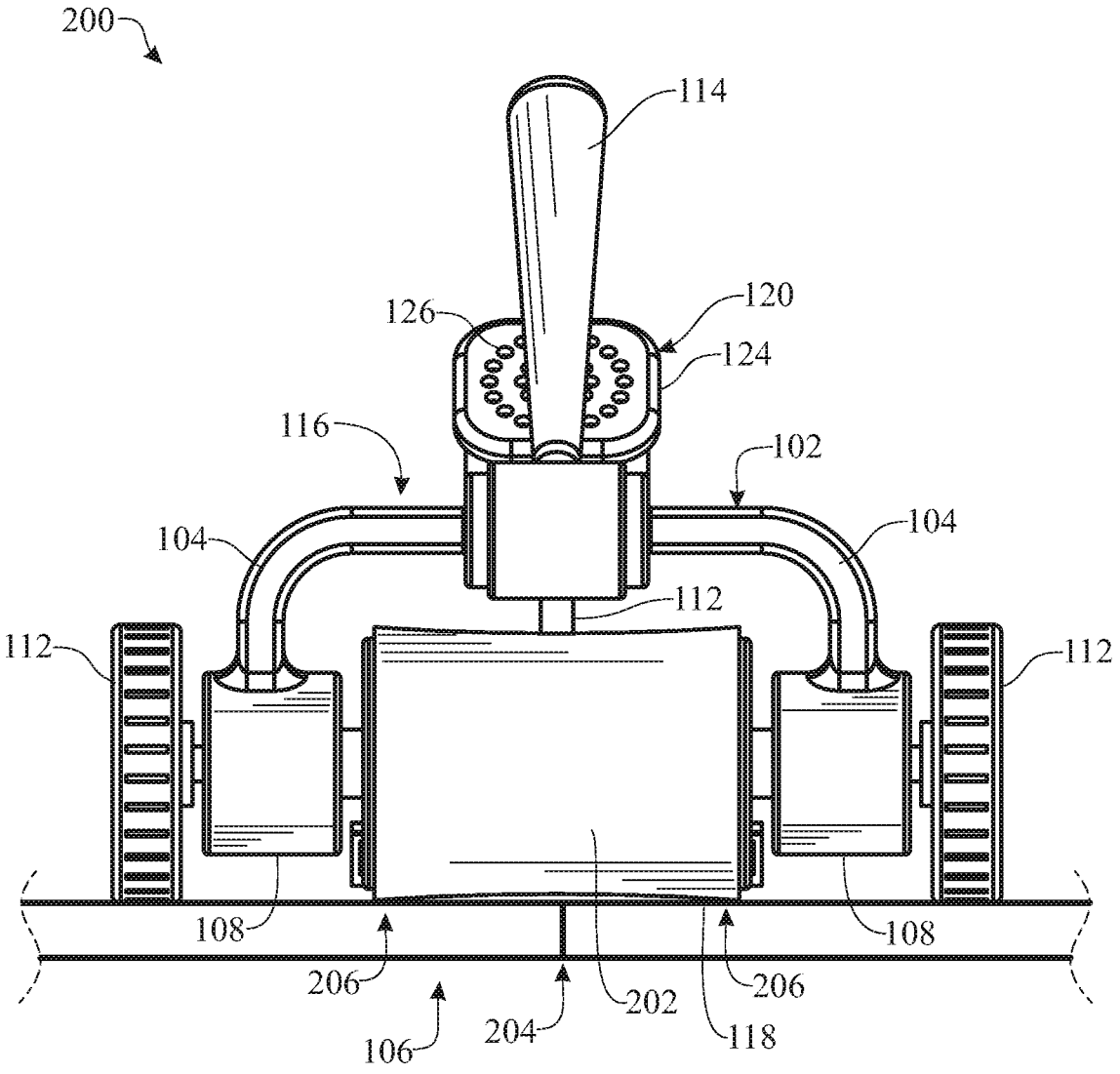
FIG. 8 presents a front elevation view of a second exemplary embodiment of a sanding apparatus, shown in operation on a non-tapered drywall seam, the apparatus including a concave roller.

The illustration of FIG. 8 shows a second embodiment of a sanding apparatus in accordance with aspects of this disclosure. Sanding apparatus 200 may include one or more of the above described features of sanding apparatus 100 of FIGS. 1-7. These elements are appropriately referenced in FIG. 8 using reference numerals that have been defined heretofore. However, unlike the previous embodiment, sanding apparatus 200 of FIG. 8 includes a concave roller 202 for sanding a vicinity of a drywall seam. The fact that the roller 202 is concave is particularly advantageous for sanding the vicinity of a non-tapered drywall seam 204, as shown in the figure, as the concave shape guarantees that only the vicinity of the seam is sanded, and that the seam itself is not. Sanding apparatus 200 of FIG. 8 may sand a spackled or a non-spackled seam. In different embodiments, concave roller ends 206 of concave roller 202 may be curved or flat to provide an appropriately smooth sanding operation. The concave roller may have any appropriate radius of concavity, or any appropriate concave shape. For example, the concavity may be selected to sand the seam such that a bump forms along the seam without interruptions. For example, a concave roller may be included to sand along a drywall seam (with a longitudinal axis of the roller being perpendicular to the seam and parallel with the surface of the drywall), wherein a concavity of the concave roller eliminates or reduces sanding spackle or spackling tape located directly above or within the seam (the space between two sheets of drywall or sheetrock). For example, the concavity may cause a continuous bump of spackle to form continuously along the seam. The bump may have any visible or physical width (lateral to the seam and parallel to a drywall surface) and any visible or physical height (lateral to the seam and perpendicular to the drywall surface). As a non-limiting example, the thickness may be in a range of 12-14 inches and the height may be less than an inch.

The illustrations of FIGS. 9-16 present a third embodiment of the disclosed sanding apparatus. FIGS. 9-16 present a vacuum sanding apparatus 900 including first handle 902, a wand 904, a second handle 906, a sanding head 908, a sanding roller 910, a first bumper 912, a second bumper 914, a top housing structure 916, a bottom housing structure 918, a vacuum hose port 920, a power cable 922, and a second handle adjuster 924.

Figure 11:
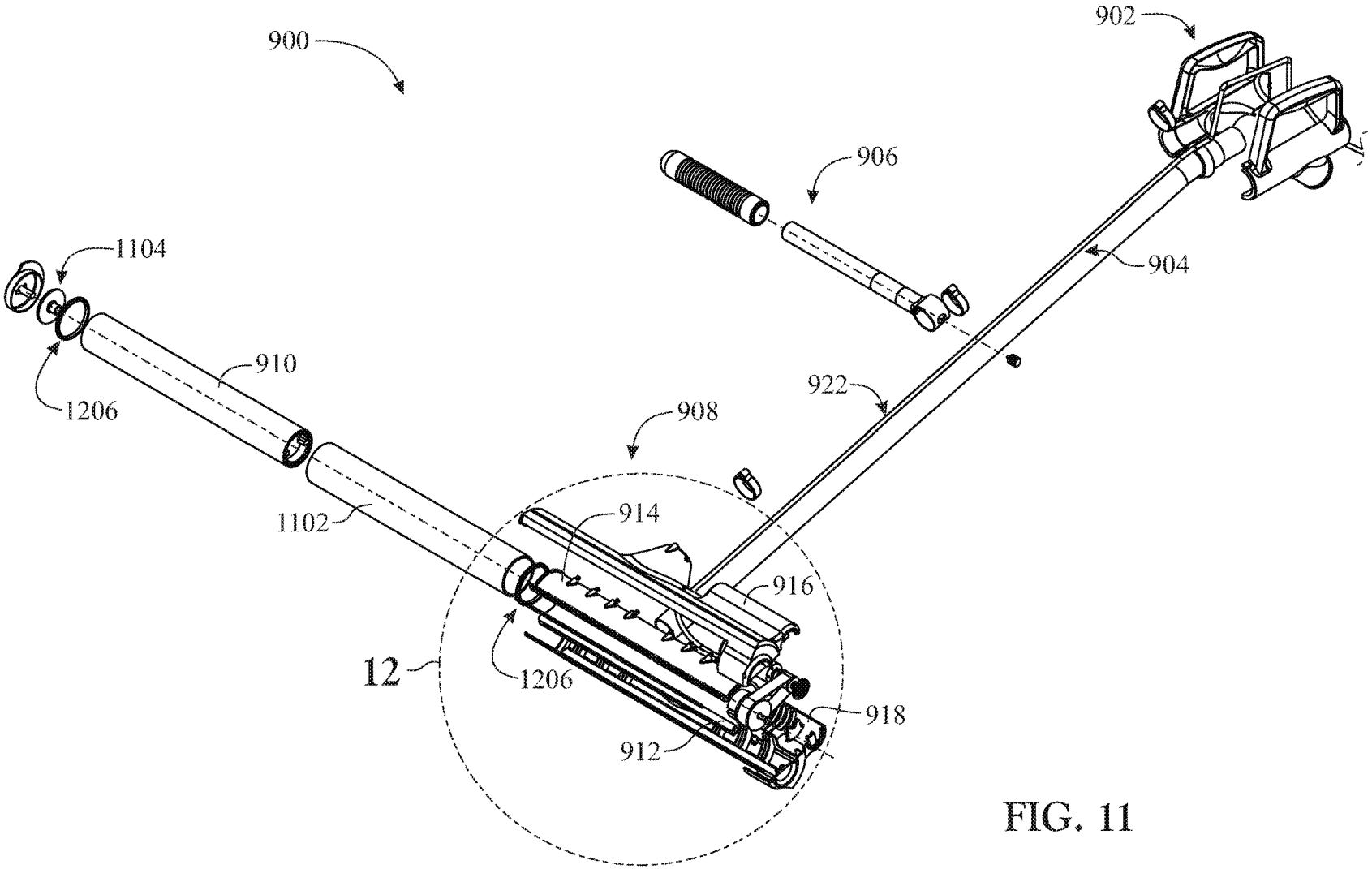
FIG. 11 presents an exploded isometric front top view of the third exemplary embodiment.

The illustration of FIG. 11 shows the sanding apparatus 900 including a core sanding roller 1102 and a housing cap 1104. The core sanding roller 1102 may be a core structure for a peripheral sanding roller (e.g. sanding roller 910). The sanding roller 910 may have or include any of the features, structures, functions, elements described with respect to any roller described herein (e.g. concave cylindrical surfaces or abrasiveness). For example, the sanding roller 910 may be configured to receive sandpaper or abrasive elements to aid in sanding a drywall, a drywall seam, or a vicinity of a drywall seam.

Figure 12:
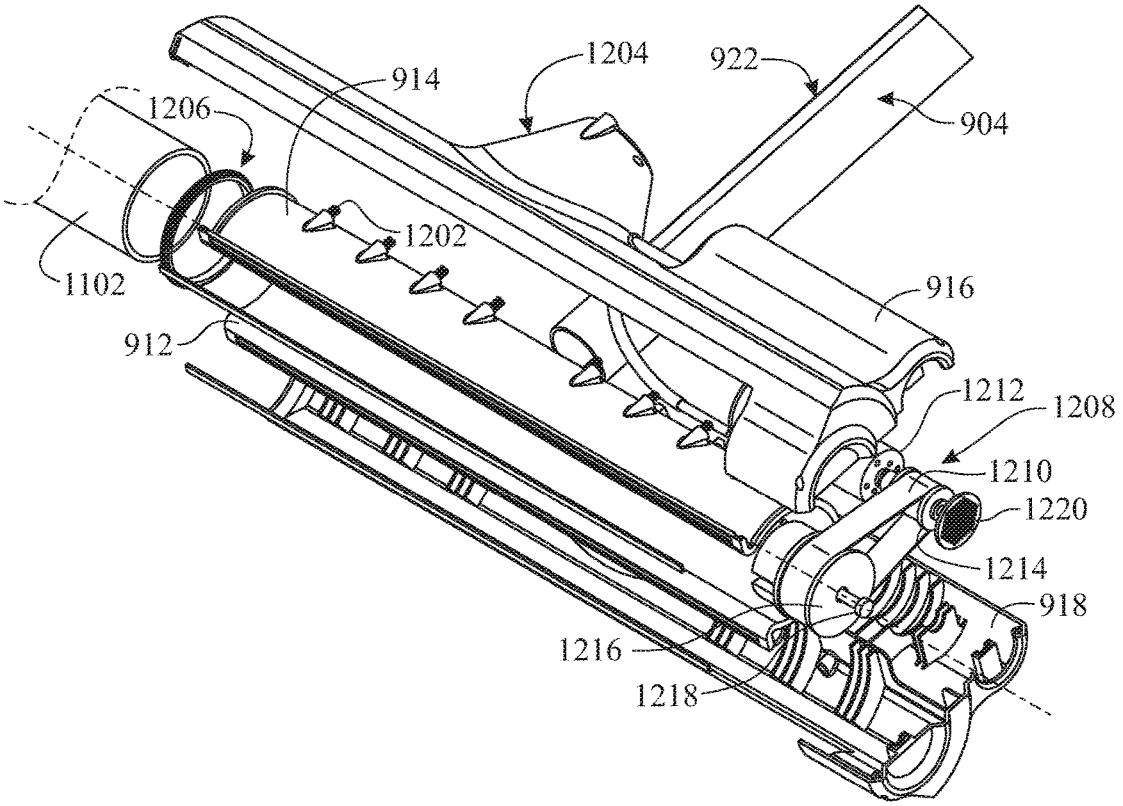
FIG. 12 presents a zoomed in isometric view of a sanding head of FIG. 11.
Figure 13:
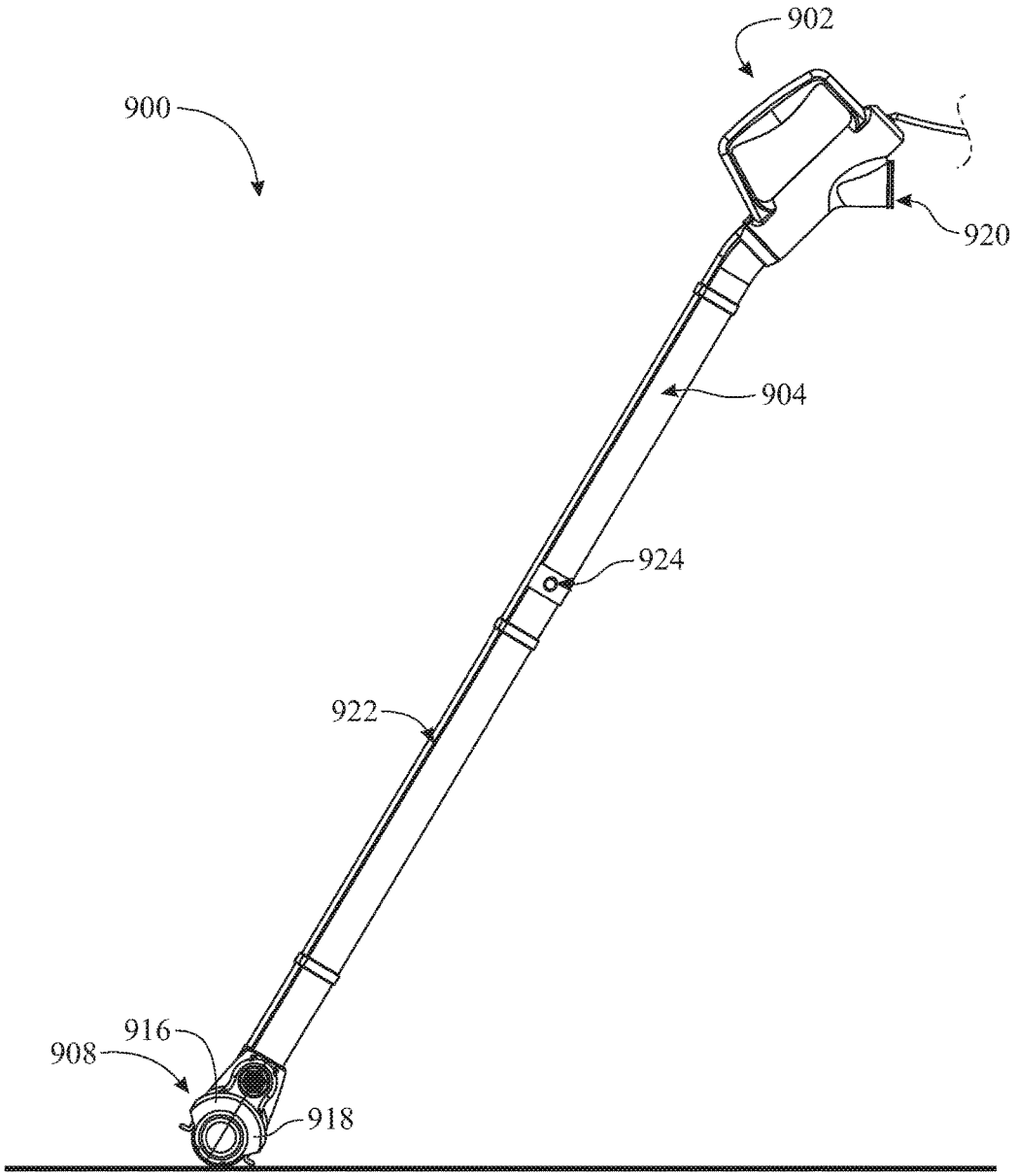
FIG. 13 presents a side elevation view of the third exemplary embodiment.
Figure 14:
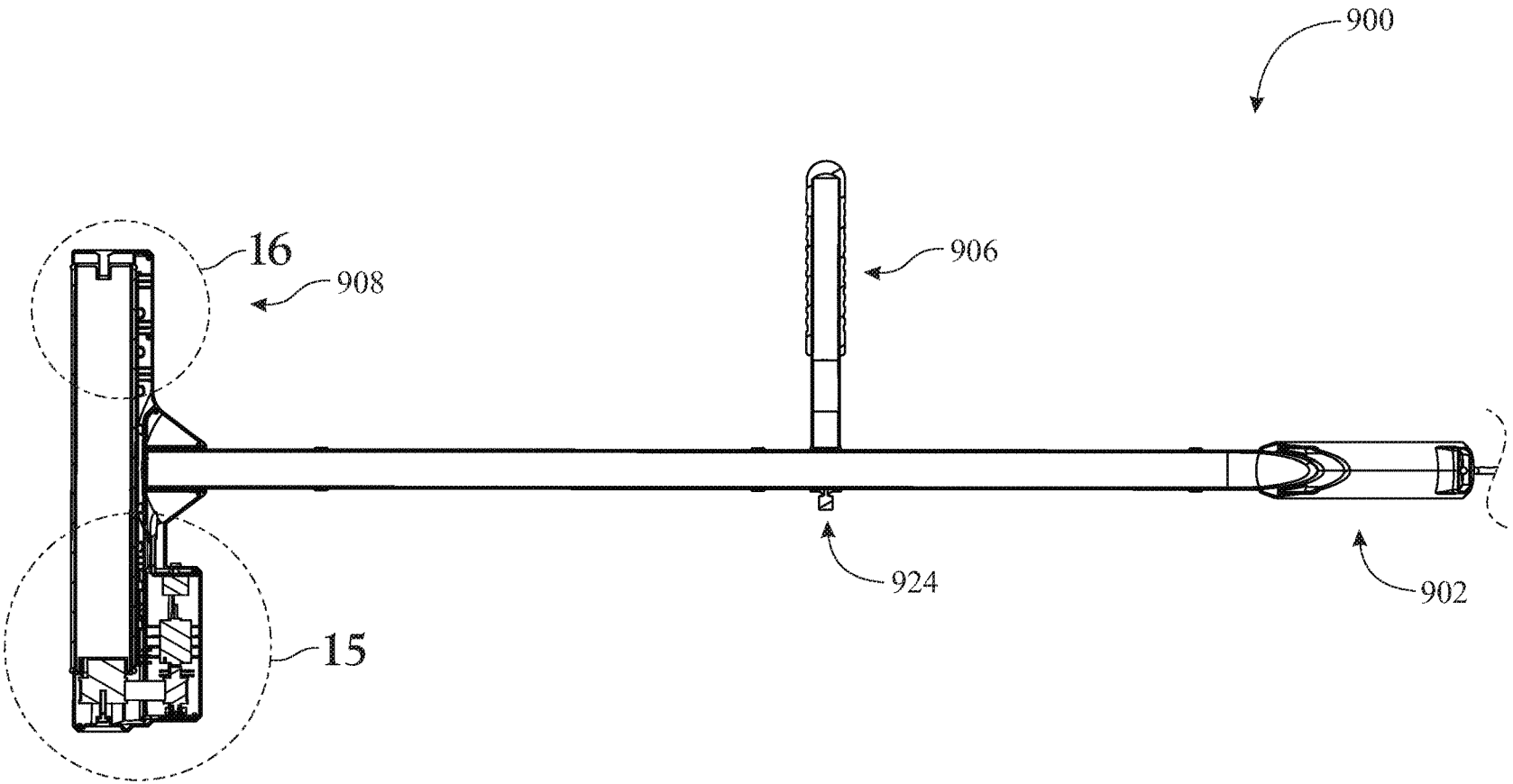
FIG. 14 presents a cross-sectional elevation view showing internal components of the third exemplary embodiment, the cross section taken along sectional plane 14-14 of FIG. 14.
Figure 15:
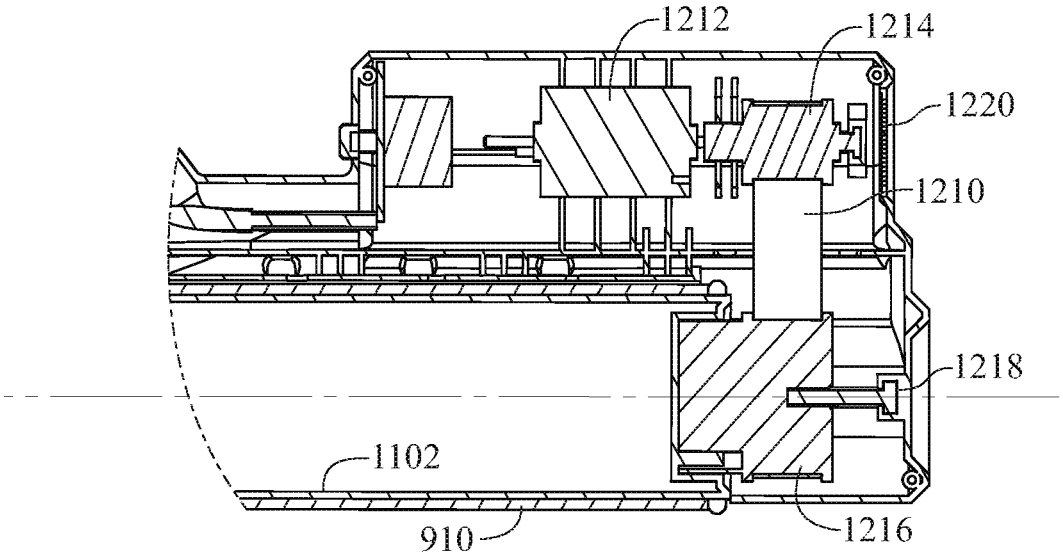
FIG. 15 presents a zoomed-in view of Section 15 of FIG. 14.
Figure 16:
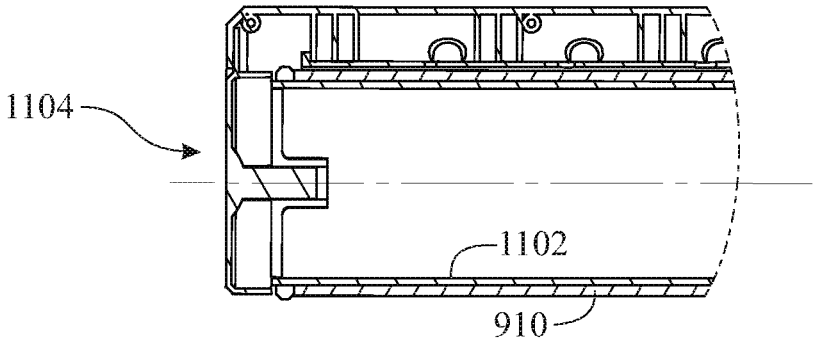
FIG. 16 presents a zoomed-in view of Section 16 of FIG. 14.

The illustration of FIG. 12 shows the sanding head 908 housing a plurality of springs 1202, a wand receiving structure 1204, a pair of roll wheels 1206, a driving mechanism 1208, a traction band 1210, a motor 1212, a band short axis 1214, a band long axis 1216, an axis rod 1218, and a vent 1220.

It is to be understood that like elements described with respect to FIGS. 1-8 also apply to like elements of FIGS. 9-16.

The vacuum sanding apparatus 900 is for sanding a drywall seam (or a vicinity of) and vacuuming resulting sanding dust.

Figure 9:
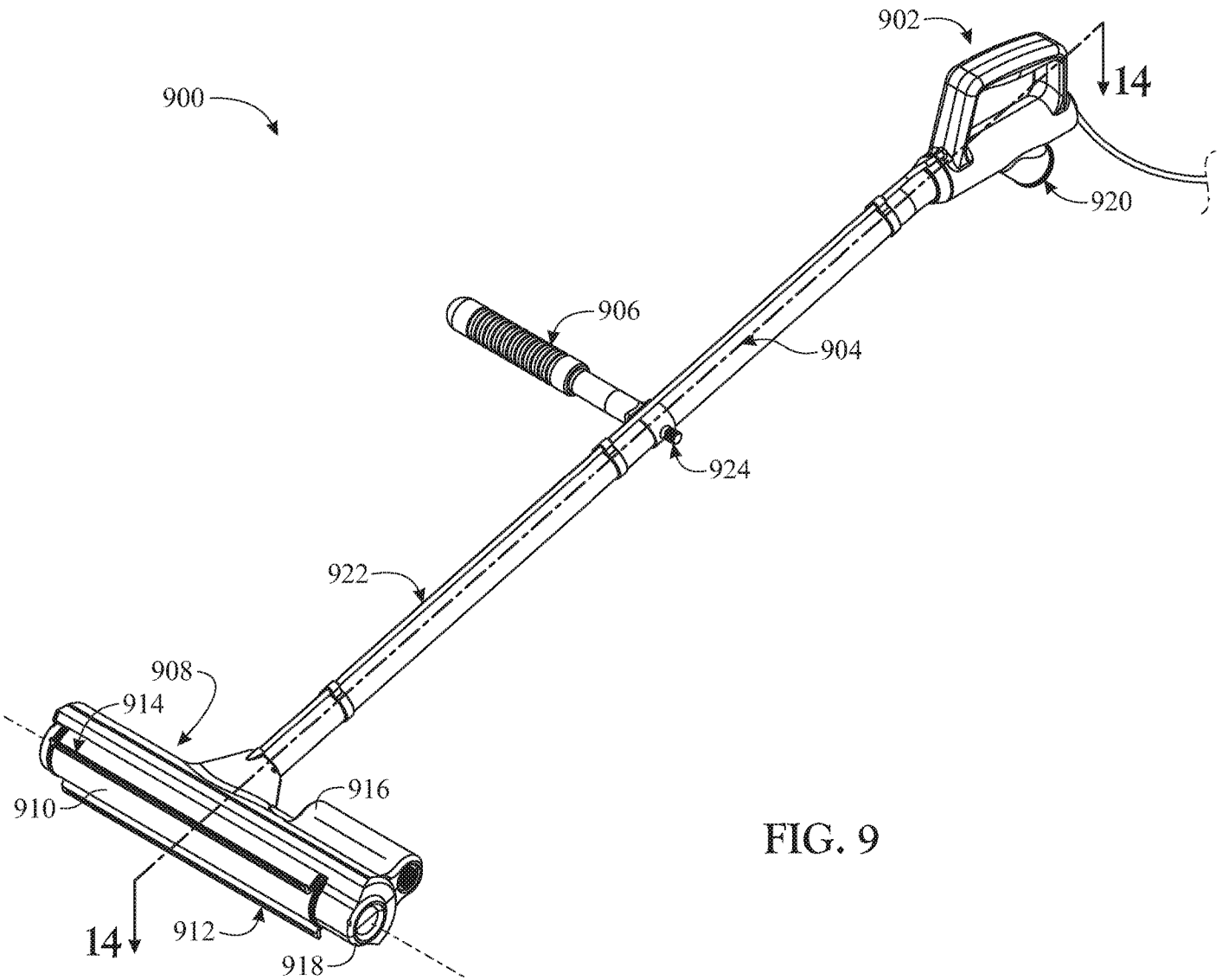
FIG. 9 presents an isometric front top view of a third exemplary embodiment of the sanding apparatus.

The sanding head 908 includes a head housing including the top housing structure 916 and the bottom housing structure 918. The top and bottom housing structures mate to form the head housing, and may be connected to each other via screws or glue. In some embodiments the housing structures are molded together to form an integral head housing. As such, the top and bottom housing structures may be curved substantially thin such that when attached to each other the housing structure is substantially hollow to house motorized sanding components described herein and shown in the figures. For example, the housing may house the sanding roller(s) and the motor 1212 for driving the sanding roller(s) about a drive axis for sanding a target surface. The wand 904 may be attached at a working end of the wand 904 to the sanding head 908. For example, the top and bottom housing structures may be configured to fit over the wand 904 or to receive and secure the wand. For example, it is anticipated that snap-fit mechanisms may be implemented to secure the wand to the head housing. Upon being secured, the wand 904 may be used to maneuver the sanding assembly. The second handle 906 may be attached laterally to the wand 904 and may include a rubber or plastic grip. The second handle 906 may be attached via an adjuster 924 such that the second handle 906 may be moved longitudinally along the wand 904 and secured at different positions for ergonomics and comfort. The first handle 902 may be attached at a longitudinal end of the wand 904 that is opposite the working end, the working end being where the sanding head is located. The first handle may be configured to be held under-handedly as shown in FIG. 9 with an upwardly extending handle. In some embodiments, the wand 904 may be pivotably attached to the sanding head 908.

Turning to FIGS. 11 and 12, the driving mechanism 1208 is more clearly shown. More particularly, the driving mechanism 1208 includes a traction band 1210 frictionally engaged (or attached) to a circumference of band short axis 1214 and band long axis 1216. The band short axis 1214 is attached to the motor 1212 such that the motor rotatably drives the band short axis 1214. Rotatably driving the band short axis 1214 causes the traction band 1210 to spin, rotate or move such that the band long axis 1216 rotates accordingly. The band long axis 1216 rotates about the axis rod 1218. The core sanding roller 1102 and/or the sanding roller 910 are fixed to the band long axis 1216 such that rotating the band long axis 1216 causes the core sanding roller 1102 and/or the sanding roller 910 to rotate about a drive axis shown via a straight dashed line. The drive axis may be substantially parallel with the axis of the axis rod 1218, the band long axis 1216 rotational axis, and/or the band short axis 1214 rotational axis. The housing cap 1104 secures the rollers (rolls) in the housing such that the rolls may be rotationally driven to sand a target surface without accidental disassembly during sanding. The driving mechanism 1208 and more particularly the motor 1212 may receive power from the power cable 922. The power cable 922 may run longitudinally along the wand 904 and plug into an external power source.

The roll wheels 1206 may be configured to have or include any or all of the functions, features, elements, structures, or the like of the above described wheels 112. For example, the roll wheels 1206 may be configured to contact a target surface for sanding, and may be driven about a wheel axis that may be parallel to the drive axis of the sanding roller. The roll wheels 1206 may be configured as described herein to guide the sanding depth. For example, the roll wheels 1206 may be sized relative to a sanding surface of the sanding roller. The distance between a rolling (contact) surface of the wheels and a sanding surface of the sanding roller may determine a sanding depth. The sanding depth may be determined by a distance between a sanding surface of the sanding roller 910 and a distal or circumferential surface of the guide structures (e.g. a contacting or rolling surface of the wheels). The roll wheels may have a diameter that is smaller than a diameter of the sanding roller such that the sanding roller contacts an un-sanded target surface before the roll wheel ultimately contacts the target surface after the target surface is sufficiently sanded. For example, the diameter of the roll wheels may limit a sanding depth of the sanding apparatus. As such, the roll wheels and their dimension may be selected by an operator for a desired sanding depth.

The roll wheels may rotate independently of a driven sanding roller (e.g. free rolling). However, in some embodiments, the roll wheels may be driven in conjunction with driving the sanding roller. For example, rotational force (e.g. torque) may be applied to the sanding roller and the roll wheels in conjunction and concurrently. In some embodiments, the torque applied to the roll wheels may be partial to the torque applied to the sanding roller. The rotation of the sanding roller cause the application of a rotational force to the wheels (e.g. fully or partially). As such, the motor may apply a rotational force to the wheels directly (or indirectly through the roller) to aid in maneuvering the sanding apparatus forward or backward, in some embodiments.

Figure 10:
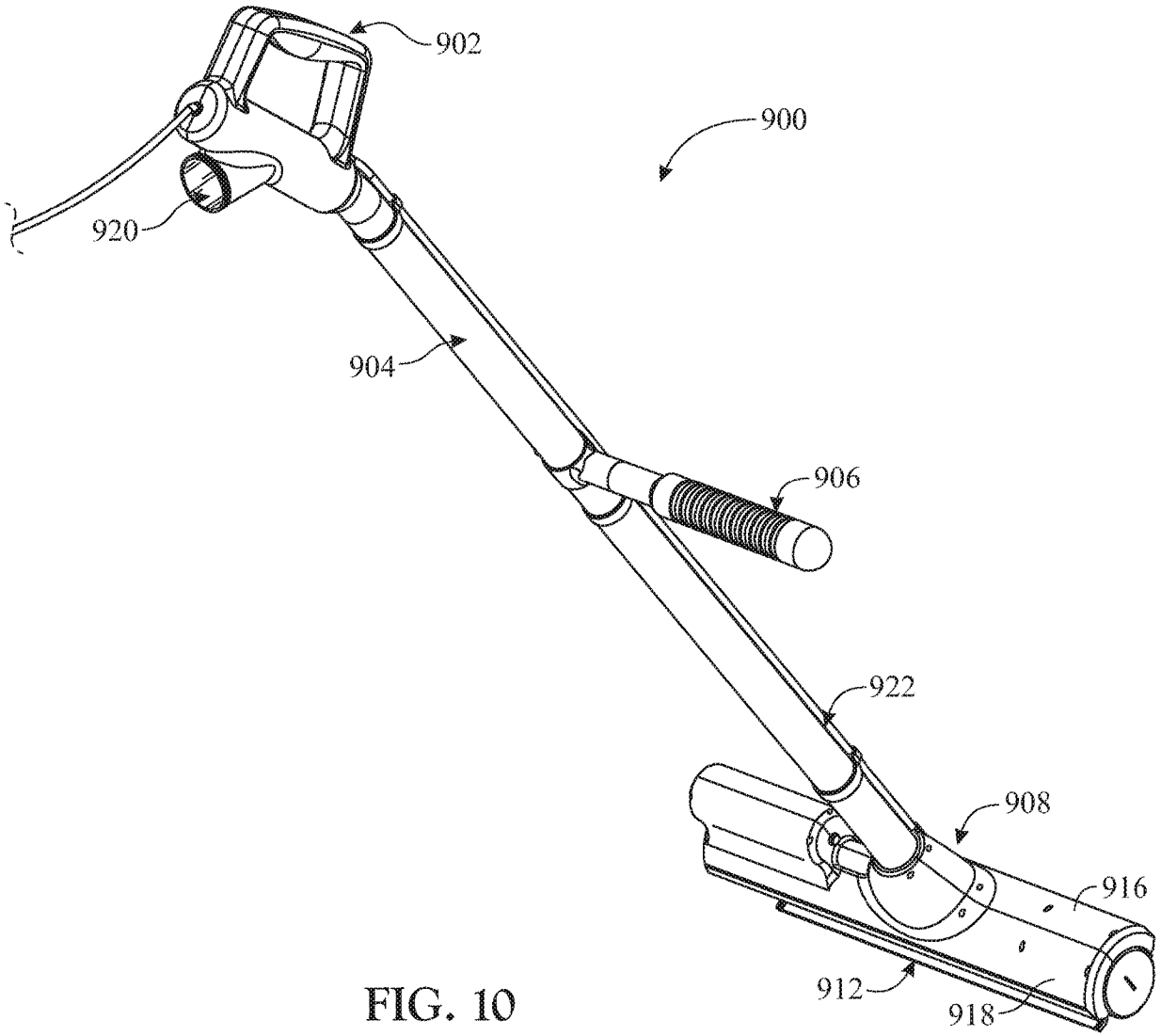
FIG. 10 presents an isometric back top view of the third exemplary embodiment.

The third embodiment further includes a vacuuming mechanism including a vacuum channel structure that defines a vacuum channel fluidly connecting a vacuum nozzle of the channel structure and a vacuum generator, the vacuum nozzle being disposed near the sanding roller for capturing sanding dust resulting from sanding a target surface. For example, the vacuum channel structure may be the wand 904, or may be included in the wand 904, in embodiments where the wand 904 is substantially tubular or hollow. As such, the wand 904 may be a vacuum tube, where the working end of the wand 904 is disposed inside, at an opening of wand receiving structure 1204 or in fluid connection with the housing of the sanding head 908, attached in an airtight manner via or at the wand receiving structure 1204. The wand may include a vacuum hose port 920 at a longitudinally opposite end from the sanding head 908 as shown in FIG. 10. For example, the vacuum hose port 920 may receive and secure a vacuum hose in an air-tight fashion in embodiments where an external vacuum generator is used. As such, a powered vacuum or vacuum generator may be air-tightly and fluidly connected to the vacuum hose port 920. The wand 904 as such may be a vacuum channel structure which attaches to an opening of the sanding head housing such that sanding dust from the roller is captured by the head housing and the vacuum channel that is defined by the wand. As such, sanding dust may be further extracted from and through the vacuum hose port 920. The first handle 902 may be configured to fit (e.g. snap fit, or via screws or glue) over the wand, and may include the vacuum hose port 920 such that the vacuum hose port 920 is fluidly connected in and through the vacuum channel of the wand (this arrangement is seen more clearly in FIG. 11 where the first handle 902 is separated). As such, the vacuum hose port 920 may be disposed at a longitudinal end of the wand or via the first handle 902. The sanding head housing, and all other components surrounding the vacuum channel may be air-tight to increase vacuuming efficiency in capturing particles from the sanding work site. The vent 1220 may be configured to provide an adequate vacuuming pressure while allowing heat from the motor to escape, or to allow flowing air from outside the housing to cool the motorized components. The vent 1220 may also behave as an air filter.

As shown more clearly in FIG. 12, the sanding head 908 may house a pair of bumpers. For example, FIG. 12 shows the sanding head 908 housing first bumper 912 and second bumper 914. The bumpers are also referred to herein invariably as shroud structures. For example, the bumpers may each be spring biased to an extended position and/or springingly retractable upon being subjected to a threshold force that overcomes a spring resistance of the plurality of springs 1202 (alone or in combination). Any number of springs may be included. As a non-limiting example, as shown in the figures, eight springs may be included on each bumper. The bumpers may be flexible or rigid, and may be composed of plastic. The ends or tips of the bumpers may be configured to slide comfortably along drywall while engaging the drywall. Since the bumpers are configured to springingly retract, the bumpers adapt to various angles of contact the sanding apparatus or wand may have with a sanding surface. As such, extended ends of the bumpers may always contact or engage a target surface while the wand engages the target surface from various angles. The ends of the bumpers always remain in contact with a target surface while the sanding roll sands the target surface, through a full swing of various angles the wand may be held with respect to the target surface. The bumpers being configured to always contact or engage the target surface from various angles of operation of the wand provides an efficient vacuuming intake at the head housing, forming a full or partial air-tight contact region between the bumpers in fluid connection with the vacuum channel. As such, the bumpers may include a light and fleecy material along their ends to make sure the bumpers are always engaged to increase a vacuuming efficiency and air-tightness at the vacuuming intake of the sanding head (e.g. at or in a vicinity of the below described cutout) while allowing the bumpers to comfortably slide across drywall or sheetrock. For example, the space between the bumpers and the below described cutout may be fluidly connected to the vacuum channel described above during sanding to aid in keeping dust from spilling or spewing away from the vacuum channel or away from a region of the housing adjacent the sanding roller. For example, the shroud structures may extend from the sanding head to trap sanding dust between the shroud structures during sanding to facilitate vacuuming the sanding dust. As such, the bumpers may increase the air-tightness of a dust intake region of the vacuuming channel and/or the sanding head (e.g. at the below described cutout) by extending the vacuuming channel to contact the target surface. Without the bumpers (i.e. shroud structures) dust may undesirably spew around a worksite during sanding. As such, the bumpers trap sanding dust to more efficiently vacuum the sanding dust via the herein described vacuum channel.

In an alternative embodiment, the bumpers may be sized and configured (e.g. via modifying the springs or a maximum or minimum displacement) according to the circumference of the sanding roller and/or wheels to aid in guiding the sanding depth. As such the bumpers may be attached such that the sanding depth or contact force (with a target surface) is guided, limited or minimized in combination with a sanding depth guided by the wheels. For example, the bumpers may springingly retract upon being forced against a target surface during sanding to cause the sanding roller or the wheels to more forcedly contact the target surface and increase or decrease the sanding depth, respectively according to their configurations (e.g. the bumpers and/or the wheel or roller circumference or diameter). Further, alone or in combination, the sanding depth may be determined by a maximum displacement of the bumpers (shroud structures) upon being springingly retracted to a maximum retraction (e.g. upon being forced against a target surface during sanding).

The housing, when assembled, includes a cutout to expose the sanding roller 910 and the vacuum channel. For example, the top and bottom housing structures may each include a cutout such that when combined, the cutouts accommodate exposing a sanding roller as described herein. For example, the cutout in the housing may be shaped to expose the roller and the bumpers in an air-tight fashion, while allowing air to be sucked through the cutout during sanding through the vacuuming mechanism.

A computer system of PCB may be included in the sanding apparatuses described herein to control and regulate the driving mechanism. For example, a PCB may be configured to control a sanding speed or a vacuum strength, and/or may be configured to automatically shut down the system upon detecting that the system is overheating. For example, such a computing system of PCB may be operatively attached to the motor 1212 to control and operate the motor 1212.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A vacuum sanding apparatus for sanding a drywall seam and vacuuming resulting sanding dust, the vacuum sanding apparatus comprising:

a sanding assembly, the sanding assembly including a motor for driving a sanding roller about a drive axis for sanding a target surface;

a handle for maneuvering the sanding assembly in sanding the target surface;

a vacuuming mechanism including a vacuum channel structure that defines a vacuum channel fluidly connecting a vacuum nozzle of the channel structure and a vacuum generator, the vacuum nozzle disposed near the sanding roller for capturing sanding dust resulting from sanding the target surface;

a pair of guide structures attached to the sanding assembly for guiding a sanding depth of sanding the target surface; and a pair of shroud structures configured to springingly retract upon being forced against the target surface during sanding, the shroud structures extending from the sanding assembly to trap sanding dust between the shroud structures during sanding.

2. The vacuum sanding apparatus of claim 1, wherein the channel structure is rigidly connected to the handle.

3. The vacuum sanding apparatus of claim 1, wherein the pair of guide structures engage a target surface for guiding the sanding depth.

4. The vacuum sanding apparatus of claim 1, wherein the sanding depth is determined by a distance between a sanding surface of the sanding roller and a point on the guide structures that is configured to engage the target surface when the target surface is being sanded for guiding the sanding depth.

5. The vacuum sanding apparatus of claim 1, wherein the handle is pivotably attached to the sanding assembly.

6. The vacuum sanding apparatus of claim 1, wherein the pair of guide structures are configured to move upon engaging the target surface during sanding.

7. The vacuum sanding apparatus of claim 1, wherein the sanding roller has a concave surface for sanding a vicinity of a drywall seam.

8. A vacuum sanding apparatus for sanding a drywall seam and vacuuming resulting sanding dust, the vacuum sanding apparatus comprising:

a U-shaped structure;

a sanding roller between two arms of the U-shaped structure for sanding a target surface;

a handle where the two arms meet;

a motor coupled to the sanding roller for driving the roller about a drive axis;

a vacuuming mechanism including a nozzle, a vacuum tube, and a vacuum generator, the nozzle being disposed near the sanding roller for vacuuming sanding dust;

a pair of wheels on opposite ends of the roller for guiding a sanding depth; and a pair of shroud structures configured to springingly retract upon being forced against the target surface during sanding, the shroud structures extending from the U-shaped structure to trap sanding dust between the shroud structures during sanding.

9. The vacuum sanding apparatus of claim 8, wherein the vacuum tube is rigidly connected to the handle.

10. The vacuum sanding apparatus of claim 8, wherein the wheels engage a target surface for guiding the sanding depth.

11. The vacuum sanding apparatus of claim 8, wherein the sanding depth is determined by a distance between a surface of the sanding roller and a point on a circumference of the wheels.

12. The vacuum sanding apparatus of claim 8, wherein the handle is pivotably attached to the sanding assembly.

13. The vacuum sanding apparatus of claim 8, wherein the wheels are configured to rotate about a wheel axis upon moving across the target surface, the wheel axis being parallel with the drive axis.

14. The vacuum sanding apparatus of claim 8, wherein the sanding roller has a concave surface for sanding a vicinity of a drywall seam.

15. A vacuum sanding apparatus for sanding a drywall seam and vacuuming resulting sanding dust, the vacuum sanding apparatus comprising:

a sanding head, the sanding head including a head housing configured to house motorized sanding components for driving a sanding roller about a drive axis for sanding a target surface;

a wand for maneuvering the sanding apparatus in sanding the target surface, the wand attached at a working end of the wand to the sanding head;

a vacuuming mechanism including a vacuum channel structure that defines a vacuum channel fluidly connecting a vacuum nozzle of the channel structure and a vacuum generator, the vacuum nozzle disposed near the sanding roller for capturing sanding dust resulting from sanding the target surface;

a pair of guide structures attached to the sanding apparatus for guiding a sanding depth of sanding the target surface; and a pair of shroud structures configured to springingly retract upon being forced against the target surface during sanding, the shroud structures extending from the sanding head to trap sanding dust between the shroud structures during sanding.

16. The vacuum sanding apparatus of claim 15, wherein the wand is the vacuum channel structure and attaches to an opening of the head housing such that sanding dust from the roller is captured by the head housing and the vacuum channel defined by the wand.

17. The vacuum sanding apparatus of claim 15, wherein the guide structures are wheels configured to rotate about a wheel axis, the wheel axis being parallel with the drive axis.

18. The vacuum sanding apparatus of claim 15, wherein the sanding depth is determined by a distance between a surface of the sanding roller and a point on a circumference of the guide structures.

19. The vacuum sanding apparatus of claim 15, wherein the wand is pivotably attached to the sanding apparatus.

* * * * *